United States Patent [19]

Ryan

[11] 4,384,523

[45] May 24, 1983

[54] FOUNTAIN CONTROL SYSTEM

[75] Inventor: Garth S. Ryan, Brossard, Canada

[73] Assignee: Mirachem Corporation, Brossard, Canada

[21] Appl. No.: 199,940

[22] Filed: Oct. 23, 1980

[51] Int. Cl.[3] ..... B41F 31/02

[52] U.S. Cl. ..... 101/210; 101/364; 210/172

[58] Field of Search ..... 222/1, 318, 56, 59, 222/60, 64, 71, 133, 134, 138, 146 C, 148, 190, 255, 405; 101/425, 364, 350, 363, 210; 210/242.3, 123, 110, 172

[56] References Cited

U.S. PATENT DOCUMENTS

| | | | |
|---|---|---|---|
| 2,582,753 | 1/1952 | Herbelleau | 222/318 |
| 2,678,733 | 5/1954 | Reeves | 210/110 |
| 2,755,933 | 7/1956 | Profit | 210/123 |
| 3,103,763 | 9/1963 | Malchair | 47/62 |
| 3,131,710 | 5/1964 | Ludwig et al. | 222/64 X |
| 3,347,416 | 10/1967 | Hamilton | 222/56 |
| 3,616,923 | 11/1971 | Haley | 210/242.3 |
| 3,675,771 | 7/1972 | McKee | 210/242.3 |
| 3,799,396 | 3/1974 | Ashmead et al. | 222/134 X |
| 3,804,297 | 4/1974 | Jurjans | 222/64 X |
| 3,869,067 | 3/1975 | Ashmead et al. | 222/134 X |
| 3,894,690 | 7/1975 | Hill | 222/318 X |
| 3,925,926 | 12/1975 | Shigeo | 47/62 |

FOREIGN PATENT DOCUMENTS

| | | | |
|---|---|---|---|
| 1050136 | 6/1979 | Canada | 222/64 |

*Primary Examiner*—Allen N. Knowles

*Attorney, Agent, or Firm*—Alan Swabey; Robert Mitchell; Guy J. Houle

[57] ABSTRACT

In a reservoir for use in treating a solution fed thereto, the improvement comprising: an overflow system, said system including: an overflow stand-pipe in the reservoir for use in skimming solution in the reservoir and removing the same therefrom; and a sensor in the reservoir for use in detecting the solution level in the reservoir and for controlling the introduction of further solution into the reservoir, thereby to control the amount of solution skimmed into the stand-pipe. In a proportioner for use in metering and dispensing specified proportions of additives, for example into a solution, the proportioner including conduit apparatus for receiving and mixing at least two solution feed supplies fed thereto, the improvement comprising: a metering pump connected to a selected one of said solution feed supplies, for metering the flow therefrom. A method of treating, including cleaning, the fountain solution of the units of printing presses while the presses are in operation including where inks of different colors are used on respective units of the presses, comprising the steps of: feeding solution to be treated from the presses and respective units thereof to a single reservoir having a stand-pipe overflow drain; and controlling the level of solution in the reservoir so as to skim-off solution containing the matter to be removed from the solution to be treated, while recirculating solution to the presses, by controllably replenishing proportioned solution in the reservoir, the proportioned solution being provided by the method as defined above.

4 Claims, 6 Drawing Figures

FOUNTAIN CONTROL SYSTEM

BACKGROUND OF THE INVENTION (a) Field of the Invention

The present invention relates to method and apparatus for use in treating solutions. It particularly relates to the treatment of solutions used by equipment employed in the printing industry.

(b) Description of Prior Art

The feeding of "etch" to a lithographic press is accomplished by the well known method of providing a fountain recirculating reservoir for each printing unit of a press. Only where color is the same on each unit, such as is generally the case with newspapers, can one reservoir handle more than one unit of a press.

SUMMARY OF INVENTION

It is therefore an important object of the present invention to overcome the aforementioned disadvantage, namely to make it possible to operate a complete press using one fountain recirculating reservoir only, regardless of the number of colors used.

It is a further important object of the present invention to make it possible to operate several complete presses using one fountain recirculating reservoir only, regardless of the number of colors used.

Other important objects will become apparent from the disclosure hereinafter.

An important advantage of a press system as discussed above is that it facilitates a more consistent fountain throughout a press and it facilitates the automation of fountain filling, mixing and control routine.

The aforementioned centralized reservoir press system is made possible by the reservoir in accordance with the present invention and more particularly its method of cleaning the fountain solution of ink, paper, oil and other foreign material. The present reservoir accomplishes this by an overflow system which operates on a timer which may be adjusted to compensate for the degree of foreign material in the fountain solution.

Thus, as a result of the present invention there is provided substantially total fountain control of printing presses. Other important advantages of a press system in accordance with the present invention, apart from providing a complete system for press "etch" control, include stability and uniformity; reduction in waste materials; less down time of machinery; solution conductivity monitoring with instant diagnosis; automatic temperature control of solution; automated consistency; automatic solution level control including safety shut-off; ultra-sonic solution level control and solid state electronics.

In one aspect of the present invention there is provided a reservoir for use in treating a solution fed thereto, the improvement comprising: an overflow system, said system including: (a) an overflow standpipe in the reservoir for use in skimming solution in the reservoir and removing the same therefrom; and (b) a sensor in said reservoir for use in detecting the solution level in the reservoir and for controlling the introduction of further solution into the reservoir, thereby to control the amount of solution skimmed into the stand-pipe.

In a further aspect of the present invention there is provided a reservoir as defined above wherein said reservoir is a printing press fountain solution distribution reservoir, the overflow system being used for treating the fountain solution including cleaning the same before it is returned to the printing press.

In a further aspect of the present invention there is provided a proportioner for use in metering and dispensing specified proportions of additives, for example into a solution, said proportioner including conduit means for receiving and mixing at least two solution feed supplies fed thereto, the improvement comprising: a metering pump connected to a selected one of said solution feed supplies, for metering the flow therefrom.

In a further aspect of the present invention there is provided a device for metering and dispensing specified proportions of additives, for example into a solution, said device comprising: (a) a frame; (b) a first means on said frame adapted to be interconnected to a first solution supply, for receiving the same; (c) a second means on said frame adapted to be interconnected to a second solution supply for receiving the same, said second means being interconnected to said first means for use in mixing said first and second solutions; (d) means on said frame for controlling the flow of said first solution through said first means; and (e) a metering pump on said frame for controlling the flow of said second solution through said second means thereby to meter the flow of said second solution into said first solution.

In a further aspect of the present invention there is provided a reservoir as defined above including a proportioner as defined above, interconnected thereto for dispensing said proportioned solution into said reservoir and further including an adjustable timer, said reservoir and proportioner being arranged such that when the level of solution in said reservoir drops below a selected point, said sensor causes said water to commence flowing through said flow regulator and said metering pump to start operating for dispensing mixed solution into said reservoir and as the level of solution in said reservoir rises, said adjustable timer is activated and subsequently deactivated following a selected period of time, thereby to halt said water flow and stop operation of said metering pump and provide that a selected amount of solution is skimmed into said stand-pipe, said selected period of time controlling the amount of solution skimmed into said stand-pipe, thus to remove foreign matter from the reservoir solution for cleaning the same.

In a further aspect of the present invention there is provided a method of cleaning the fountain solution of the units of printing presses, for example to remove ink, paper, oil and other matter from the solution, comprising the steps of: (a) feeding a solution to be cleaned from the press to a reservoir having a stand-pipe overflow drain; and (b) controlling the level of solution in the reservoir so as to skim-off solution containing the matter to be removed, while recirculating solution to the press, by controllably replenishing proportioned solution in the reservoir.

In a further aspect of the present invention there is provided a method of metering and dispensing specified proportions of additives, thereby to provide a proportioned solution, comprising the steps of: (a) flowing a first solution through a first conduit in a regulated manner; (b) flowing a second solution through a second conduit having a metering pump therein so as to dispense a precise quantity of said second solution therefrom; (c) introducing said second dispensed solution to said first solution for mixing therewith; and (d) dispensing said mixed solution.

In a further aspect of the present invention there is provided a method of treating, including cleaning, the fountain solution of the units of printing presses while the presses are in operation including where inks of different colors are used on respective units of the presses, comprising the steps of: (a) feeding solution to be treated from the presses and respective units thereof to a single reservoir having a stand-pipe overflow drain; and (b) controlling the level of solution in the reservoir so as to skim-off solution containing the matter to be removed from the solution to be treated, while recirculating solution to the presses, by controllably replenishing proportioned solution in the reservoir, the proportioned solution being provided by the method as defined above.

BRIEF DESCRIPTION OF DRAWINGS

The invention is illustrated by way of example in the accompanying drawings wherein.

DESCRIPTION OF PREFERRED EMBODIMENTS

Figure 1:
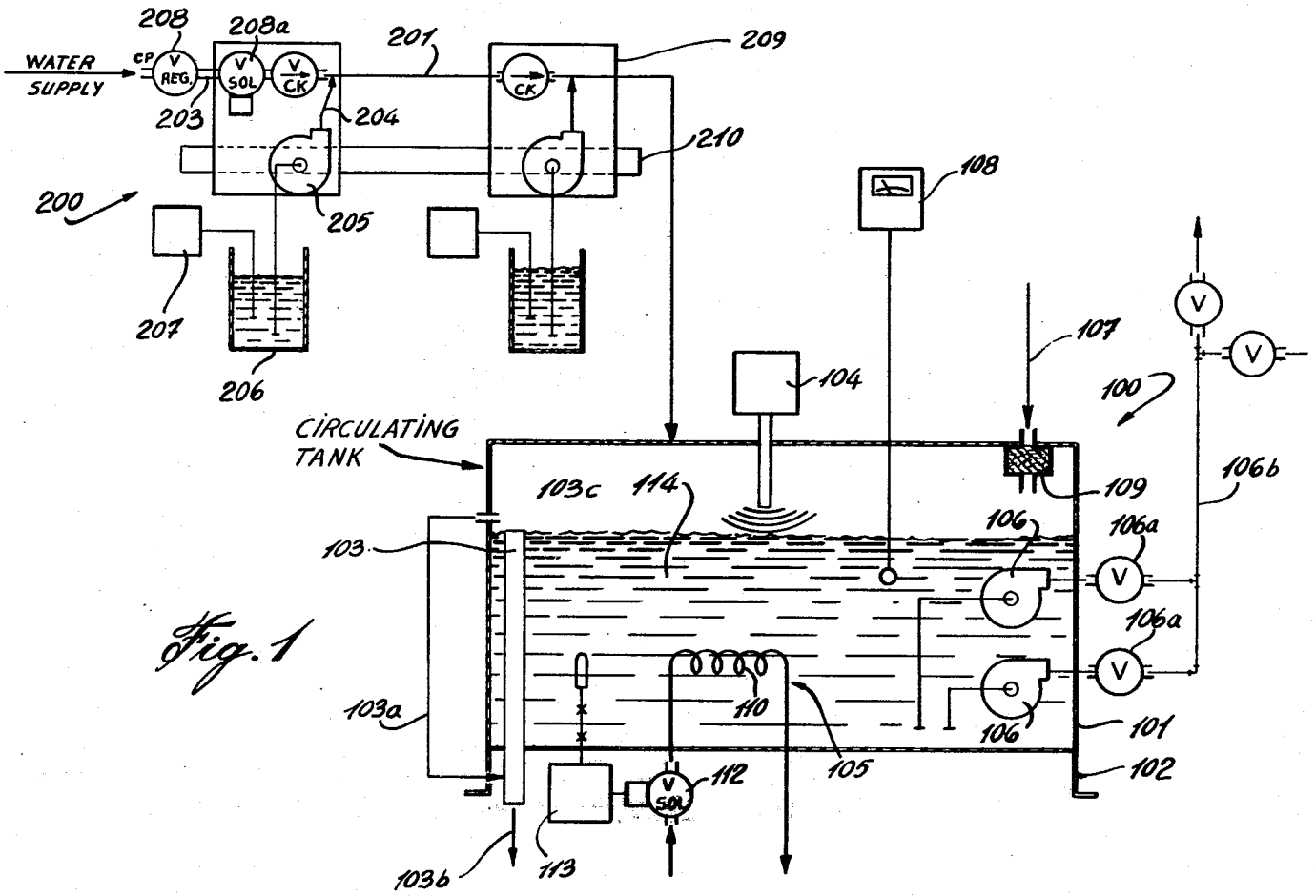
FIG. 1 is a schematic diagram showing a system in accordance with the present invention.
Figure 2:
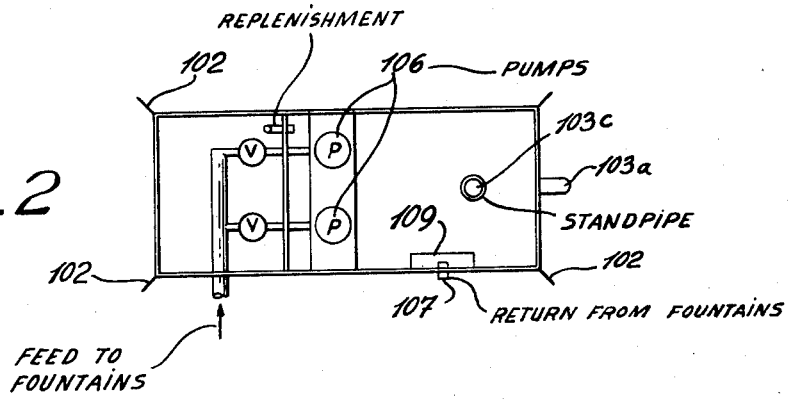
FIGS. 2 and 2*a* respectively are a diagrammatic plan and side view of a distribution reservoir in accordance with the present invention.
Figure 2A:
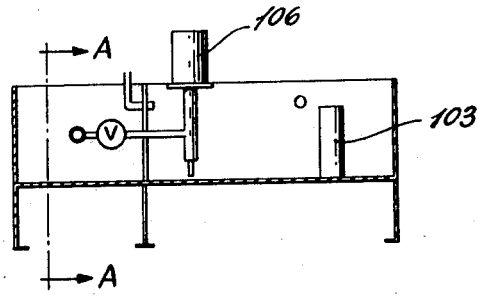
Figure 2B:
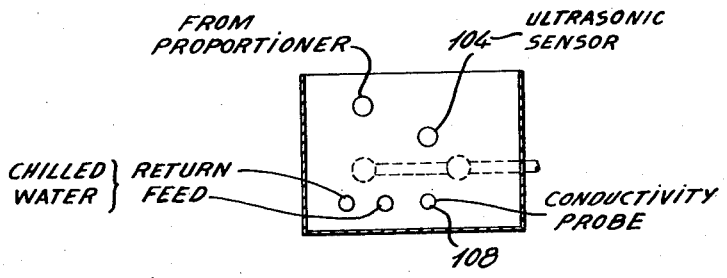
FIG. 2*b* is a sectional diagrammatic view taking along line A—A in FIG. 2*a;*

Referring now in detail to the drawings. Referring to FIG. 1 there is seen a circulating reservoir 100 and a proportioner unit 200. Reservoir 100, as also seen in FIG. 2 and FIG. 2*a,* comprises a tank 101 suitably mounted on support frame 102. Within tank 101 is mounted an overflow stand-pipe drain 103; an ultrasonic solution level sensor 104; thermostatically controlled solution cooling means 105; pumps 106; solution intake 107; solution conductivity probe 108; solution filter 109 and a safety overflow 103*a.*

Tank 101 may be of any suitable well known type as for example shown in the drawings. The capacity of tank 101 may also be of any suitable amount including 50 imperial gallons. Construction details of tank 101 have been omitted since those skilled in the art are deemed well familiar with such constructions.

Stand-pipe 103 comprises a tubular pipe 103*c* upstanding from the base of tank 101 and being detachably secured thereto by screw thread. Stand-pipe 103 extends upwardly within tank 101 a selected distance corresponding to for example that seen in FIG. 1. Pipe 103 also extends below the bottom of tank 101 where it is joined by emergency overflow pipe 103*a* prior to entering drain 103*b.*

Level sensor 104 may be of any suitable type including of the ultra-sonic type shown in FIG. 1. Such item is commercially available under the trade name "sensall" and sold by Envirotech Corporation and complete instructions for installing sensor 104 are provided by the manufacturer.

Thermostatically controlled solution cooling system 105 comprises a coiled tubular member 110 constructed according to well known design and includes basically a series of coils of copper piping, the flow through the coil being controlled by a valve 112 interconnected and in turn controlled by thermostat 113 in communication with solution 114 in tank 101. Cooling system 105 may, if desired, as seen in FIG. 1, be interconnected to the chill rollers of a printing press thereby being supplied with chilled water as a cooling agent.

Attention is directed to FIG. 2*a* and the position of the inlet replenishment source in tank 101, which it will be realized is strategically placed so as to drive particulate in solution 114 toward stand-pipe drain 103 and the vortexing of fluid when draining therethrough. Also of note is the positioning of pumps 106 so as to pump solution from the bottom of tank 101, thereby to pick up clean solution in the path of cooling coiled tubular member 110.

Pumps 106 may be of any well known commercially available suitable type for use in circulating solution from and to the printing press or device being serviced, via tank 101. Two pumps 106 are utilized in the one preferred embodiment disclosed, one pump being used as a back-up for the other and also to ensure rapid draining of solution from tank 101. Shut-off valves 106 are provided for controlling flow from pumps 106. Detailed installation instructions of pumps 106 is also omitted as those skilled in the art are deemed well familiar with such installation. As seen in FIG. 1, pumps 106 are interconnected for feeding press fountains via pipe 106*b.*

Solution intake 107 comprises piping secured to tank 101 for use in delivering solution thereto from fountains on presses, the solution of which is to be treated.

Located adjacent intake 107 is solution filter 109 suitably secured in tank 101 by suitable means and which also may be of any well known design, for use in pre-filtering relatively large foreign material in the solution to be treated. Filter 109 comprises a grill mesh providing a selected restriction of solution flow therethrough. Thus, filter 109 is located intermediate solution 114 and intake 107.

Safety overflow 103*a* comprises a pipe running exteriorly of tank 101 being positioned to receive solution 114 should pipe 103 become obstructed or if there is too much solution entering tank 101 for stand-pipe 103 to handle and to thus prevent overflowing of tank 101.

Referring again to intake 107, it is interconnected to the fountains of a plurality of press units comprising a number of presses and wherein the various press units, one to another, are using different colored inks while printing.

Conductivity probe 108 may be of any suitable type including ones commercially available for monitoring the condition of solution. Probe 108 provides continuous monitoring providing measurements in micro MHOS/CM of total dissolved solids. Such probes including monitoring solution temperature may include chart recording and direct continuous read out facility. Installation of probe 108 like other features of the present system is provided by the manufacturers of the same and thus detailed instructions may be had from the source of supply and interconnected with reference to the present drawings.

Proportioner unit 200 as seen in FIG. 1 for use in mixing solutions and dispensing the same to tank 101 includes conduit means 201 for receiving solutions respectively from feed supplies 203 and 204. Feed supply 203 carries water while feed supply 204 carries a reagent pumped from a drum 206 by a metering pump 205.

Metering pump 205 is of a commercially available type such as model R1-S-E manufactured by Interpace Corporation and includes a vernier type control for metering the flow of solution therethrough. Drum 206 further includes a level sensor 207 also being of commercially available type namely model 50–55 manufactured by Chemi-Tec Equipment Company for alarm signalling and shut-off of the proportioner unit 200. Upstream of conduit 204 as it enters conduit 201 is a well known flow regulator 208 for controlling the flow of water entering conduit 201.

As seen in FIG. 1, an optional slave unit 209 may be utilized, being similar to the aforementioned described unit of proportioner unit 200 and mounted upon a common frame 210.

Reservoir 100 and proportioner 200 are interconnected generally as shown in FIG. 1 using PVC or copper piping and preferably insulated as indicated in the drawings. Operation of the combined proportioner 200 and reservoir 100 are controlled by an arrangement 300 shown schematically in FIG. 3. Arrangement 300 with its components may, as in the present embodiment, be housed in a common frame with that of proportioner unit 200, drum 206 being located remote therefrom. Interconnection of reservoir 100 with a plurality of printing press units may be as shown diagrammatically in FIG. 4 including having a positive return pump, thus to provide a system for treating fountain solution of the presses including while the same are in operation.

Turning now to the operation of the system described herein and illustrated in the present figures.

The fountain control system in accordance with the present invention and as disclosed is a self-contained system that will meter specified proportions of additives into the fountain solution of printing presses. The system is fully automatic and requires virtually no attention once it has been properly installed and started up.

When the level of solution 114 in reservoir 100 drops, level sensor 104 causes water solenoid valve **208*a* to open and metering pump 205 to start. As the level of solution 114 rises in reservoir 100, an adjustable timer seen in arrangement 300 is started and when it has elapsed, metering pump 205 stops and water solenoid valve 208*a* halts the flow of water. By adjusting the timer, the amount of solutions skimmed into stand-pipe 103 can be controlled. If level sensor 207 in the reagent drum 206 detects a low level, metering pump 205 will not start. A warning light is provided in arrangement 300 to indicate low level of reagent in the drum 206 and also an alarm buzzer seen in arrangement 300** will sound.

The amount of reagent injected into the water is controlled by turning a calibrated knob, referred elsewhere herein as a vernier, on metering pump 205. Conductivity probe 108 in reservoir 100 measures the concentration of "etch" in the solution 114. Metering pump 205 flow rate can be adjusted at any time even if pump 205 is running. Turning of the vernier knob clockwise or counterclockwise will respectively increase or decrease the flow therethrough. The flow rate is indicated in 0.5% increments from 0–100%, on the barrel of the adjusting knob. Cooling means 105 is thermostatically adjusted so as to maintain the solution 114 at a constant temperature.

The skim-timer located and seen in arrangement 300 is wired so as to allow fresh fountain solution into reservoir 100 for an adjustable amount of time as indicated previously. The amount of time also as indicated previously, can be varied so that reservoir 100 is over filled, thus causing excess solution to drain down stand-pipe 103. Thus, the timer is set so that solution 114 stays clean without excessive waste to the drain.

Figure 3:
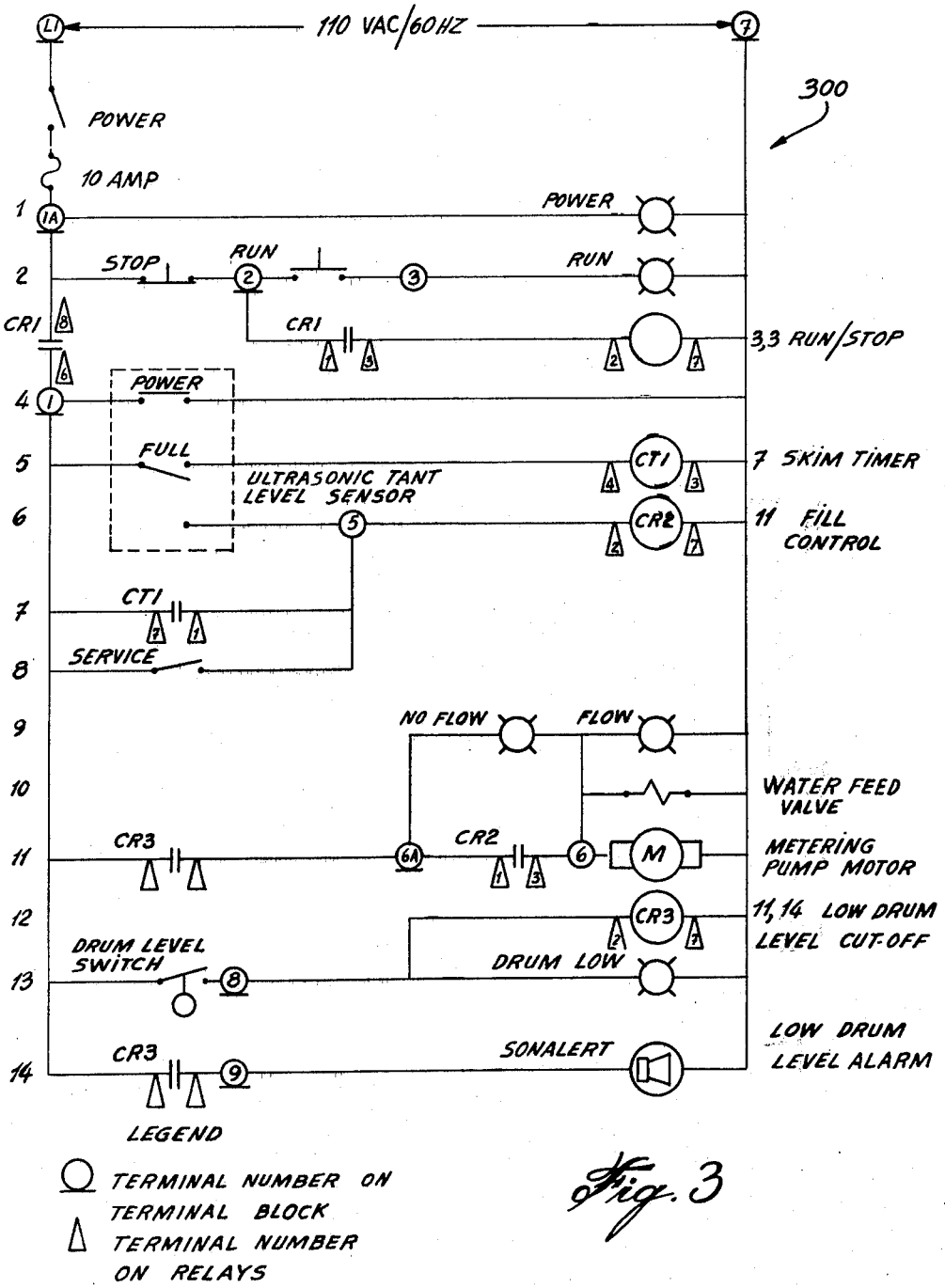
FIG. 3 is a control schematic diagram for use in a system in accordance with the present invention.
Figure 4:
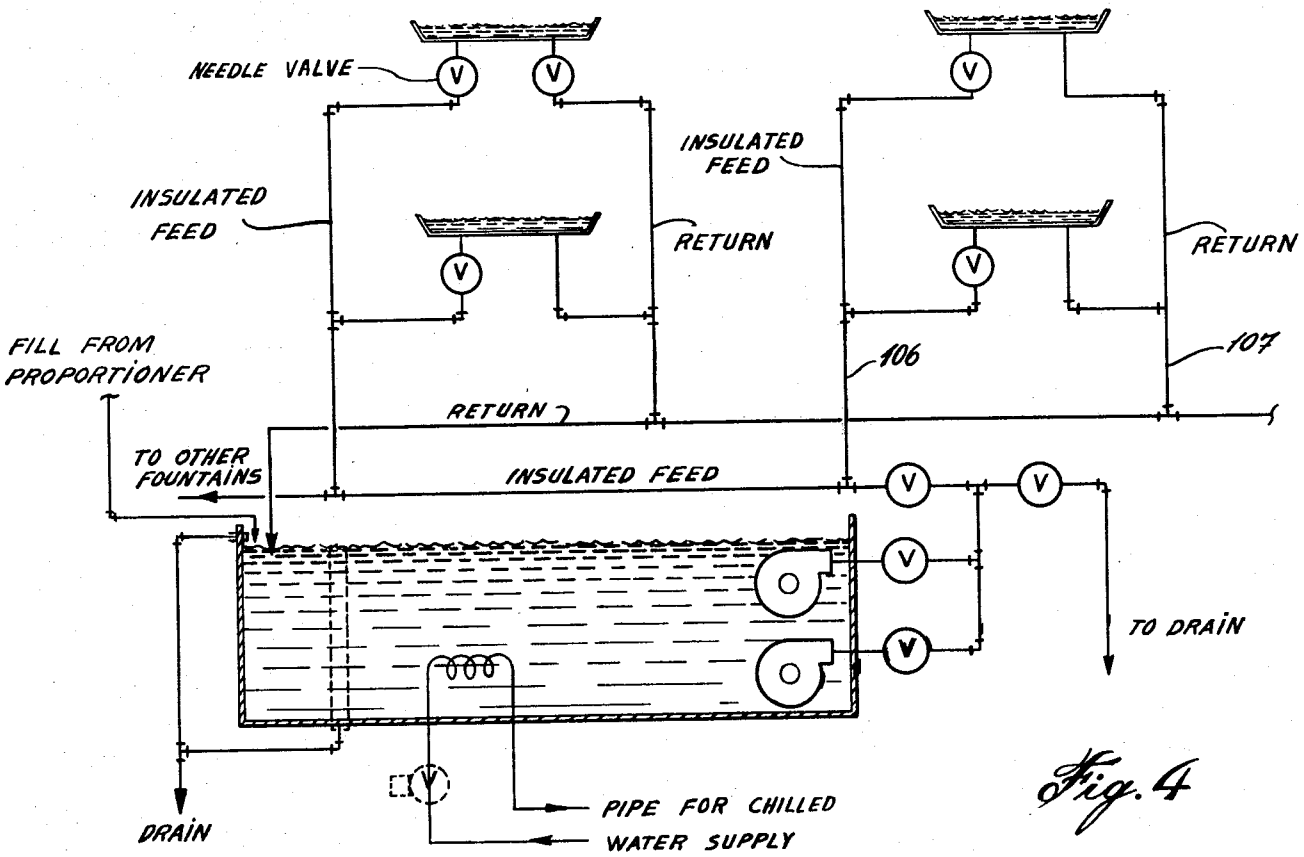
FIG. 4 is a schematic diagram showing piping connections between a reservoir in accordance with the present invention and fountains of printing presses located remote therefrom.

Referring to FIGS. 1 and 3, it is advisable not to start circulating pumps 106 unless the level in reservoir 100 is well above the pump inlet. Drawing air mixed with the solution will cause severe cavitation and could damage the pump motor shaft and related parts. After verifying the water supply is on and that the reagent drum 206 is full, the power switch on arrangement 300 may be turned to "on" position. The power light will then come on. Next, the "run" button may be pushed. The "run" light will come on, on arrangement 300. If reservoir 100 level is low or empty, the water solenoid valve **208*a* will open, metering pump 205 will start and the "flow" light will come on, on arrangement 300. If reservoir 100 is full then the "no flow" light will come on, on arrangement 300. Once the level in reservoir 100 is above the circulating pump 106 intake, circulating pump 106 may be started via a switch on the motor. When the level in reagent drum 206 gets too low the "low" light and "sonalert" alarm will come on, on arrangement 300. The water valve 208 and metering pump 205** will be automatically turned off.

Although the preferred embodiment disclosed herein is directed to the treatment of fountain press solution, it is visualized other solutions may be readily treated by the present apparatus, including solution used in conjunction with various other equipment. Thus, as indicated at the beginning hereof, the present invention relates to method and apparatus for use in treating solutions generally.

I claim:

1. In a reservoir for use in treating a solution fed thereto, the improvement comprising said reservoir being a printing press fountain solution distribution reservoir, an overflow system for treating a fountain solution including cleaning the same before it is returned to a printing press; said overflow system including an overflow stand-pipe in the reservoir for use in skimming solution in the reservoir and removing the same therefrom, and a sensor of the ultrasonic type in said reservoir for use in detecting the solution level in the reservoir and for controlling the introduction of further solution into the reservoir, thereby to control the amount of solution skimmed into the stand-pipe; thermostatically controlled solution cooling means, a proportioner interconnected to said reservoir for dispensing a proportioned solution into said reservoir and further including an adjustable timer, said proportioner including conduit means for receiving and mixing at least two solution feed supplies fed thereto and including a metering pump connected to a selected one of said solution feed supplies for metering the flow therefrom, said pump being connected directly to said conduit means and including a vernier type control for metering the flow of solution therethrough for mixing with the other of said solutions, said metered solution being a reagent and the other solution being water, and said porportioner including a flow regulator for regulating the flow of said water, said reservoir and proportioner being arranged such that when the level of solution in said reservoir drops below a selected point, said sensor causes said water to commence flowing through said flow regulator and said metering pump to start operating for dispensing mixed solution into said reservoir and as the level of solution in said reservoir rises, said adjustable timer being activated and subsequently deactivated following a selected period of time, thereby to halt said water flow and stop operation of said metering pump and provide that a selected amount of solution is skimmed into said stand-pipe, said selected period of time controlling the amount of solution skimmed into said stand-pipe, thus to remove foreign matter from the reservoir solution for cleaning the same.

2. A reservoir and proportioner combination as defined in claim 1 wherein the same is interconnected to the fountain of at least one printing unit of a printing press, said interconnection providing for the cleaning of the fountain solution.

3. A reservoir and proportioner combination as defined in claim 2 wherein the same is interconnected to the fountains of a plurality of printing units of a printing press for use in cleaning the fountain solution used by the respective units and wherein the respective units use different colored printing inks, one to another.

4. A reservoir and proportioner combination as defined in claim 3 wherein the same is interconnected to the fountains of a plurality of printing units of a plurality of printing presses for use in cleaning the fountain solution used by the respective units and wherein each unit of a respective press is using a different color printing ink, one to another, thereby to provide a centralized solution cleaning device and a centralized proportioner for a plurality of said presses.

* * * * *